US009694581B2

(12) United States Patent
Yoshida

(10) Patent No.: US 9,694,581 B2
(45) Date of Patent: Jul. 4, 2017

(54) LIQUID DISCHARGE HEAD, LIQUID DISCHARGE DEVICE, LIQUID DISCHARGE APPARATUS, AND IMAGE FORMING APPARATUS

(71) Applicant: Takahiro Yoshida, Ibaraki (JP)

(72) Inventor: Takahiro Yoshida, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/092,755

(22) Filed: Apr. 7, 2016

(65) Prior Publication Data

US 2016/0297193 A1 Oct. 13, 2016

(30) Foreign Application Priority Data

Apr. 9, 2015 (JP) ..... 2015-080046
Feb. 8, 2016 (JP) ..... 2016-021504

(51) Int. Cl.
*B41J 2/14* (2006.01)
*B41J 2/135* (2006.01)

(52) U.S. Cl.
CPC ..... *B41J 2/14274* (2013.01); *B41J 2/135* (2013.01); *B41J 2/14024* (2013.01); *B41J 2/14032* (2013.01); *B41J 2202/11* (2013.01); *B41J 2202/12* (2013.01)

(58) Field of Classification Search
CPC ..... B41J 2/145; B41J 2/18; B41J 2/135; B41J 2/14; B41J 2/14024; B41J 2/14032
See application file for complete search history.

(56) References Cited

U.S. PATENT DOCUMENTS 8,011,765 B2 * 9/2011 Katoh ..... B41J 2/14145 347/85
2003/0210305 A1 * 11/2003 Ito ..... B41J 2/14209 347/68
2014/0218450 A1 * 8/2014 Yoneta ..... B41J 2/17563 347/93

FOREIGN PATENT DOCUMENTS

JP 2007-313707 12/2007
JP 2012-143948 8/2012

* cited by examiner

*Primary Examiner* — Julian Huffman
*Assistant Examiner* — Sharon A Polk
(74) *Attorney, Agent, or Firm* — Cooper & Dunham LLP

(57) ABSTRACT

A liquid discharge head includes a nozzle row, individual liquid chambers, a common liquid chamber, a circulation liquid chamber, a supply port, and a delivery port. The nozzle row includes nozzles to discharge liquid. The nozzles are arrayed in a nozzle array direction. The individual liquid chambers are communicated with the nozzles and arrayed in the nozzle array direction. The common liquid chamber extends longer in the nozzle array direction, to supply liquid to the individual liquid chambers. The circulation liquid chamber is communicated with the individual liquid chambers. The supply port is disposed at a center of the common liquid chamber in the nozzle array direction, to supply liquid to the common liquid chamber. The delivery port is disposed outside the common liquid chamber in the nozzle array direction, to deliver liquid from the circulation liquid chamber.

16 Claims, 13 Drawing Sheets

LIQUID DISCHARGE HEAD, LIQUID DISCHARGE DEVICE, LIQUID DISCHARGE APPARATUS, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2015-080046, filed on Apr. 9, 2015, and 2016-021504, filed on Feb. 8, 2016, in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus, and an image forming apparatus.

Related Art

A circulatory liquid discharge head to circulate liquid is known as a liquid discharge head of an image forming apparatus to discharge liquid.

Such a liquid discharge head includes, for example, a plurality of pressure generation chambers arranged in a nozzle array direction and communicated with respective nozzles of each nozzle row in which the nozzles are arrayed and a common liquid chamber extending longer in the nozzle array direction to supply liquid to the plurality of pressure generation chambers. The liquid discharge head further includes a supply port communicated with the common liquid chamber to supply ink to the common liquid chamber and a delivery port communicated with a circulation channel communicated with the plurality of pressure generation chambers to deliver ink from the circulation channel. The supply port is communicated with an upper portion of one end of the common liquid chamber in the nozzle array direction. The delivery port is disposed at a position outer than the common liquid chamber on an opposite side of the supply port in the nozzle array direction.

SUMMARY

In an aspect of this disclosure, there is provided a liquid discharge head that includes a nozzle row, a plurality of individual liquid chambers, a common liquid chamber, a circulation liquid chamber, a supply port, and a delivery port. The nozzle row includes a plurality of nozzles to discharge liquid. The plurality of nozzles is arrayed in a nozzle array direction. The plurality of individual liquid chambers is communicated with the plurality of nozzles and arrayed in the nozzle array direction. The common liquid chamber extends longer in the nozzle array direction, to supply liquid to the plurality of individual liquid chambers. The circulation liquid chamber is communicated with the plurality of individual liquid chambers. The supply port is disposed at a center of the common liquid chamber in the nozzle array direction, to supply liquid to the common liquid chamber. The delivery port is disposed outside the common liquid chamber in the nozzle array direction, to deliver liquid from the circulation liquid chamber.

In another aspect of this disclosure, there is provided a liquid discharge device that includes the liquid discharge head and at least one of a head tank, a carriage, a supply device, a maintenance device, and a main-scanning moving device.

In still another aspect of this disclosure, there is provided a liquid discharge apparatus that includes the liquid discharge device.

In still yet another aspect of this disclosure, there is provided an image forming apparatus that includes the liquid discharge device to discharge liquid droplets from the liquid discharge head to from an image.

In further yet another aspect of this disclosure, there is provided a liquid discharge apparatus that includes the liquid discharge head.

In still further yet another aspect of this disclosure, there is provided an image forming apparatus that the liquid discharge head to discharge liquid droplets to form an image.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
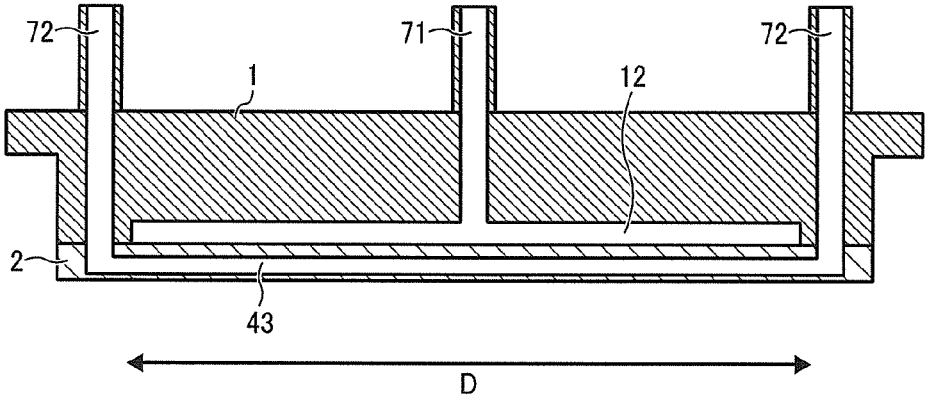
FIG. 1 is a cross-sectional view of an example of a liquid discharge head cut along line A-A' of FIG. 6.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure are described with reference to the attached drawings.

First Embodiment

Figure 2:
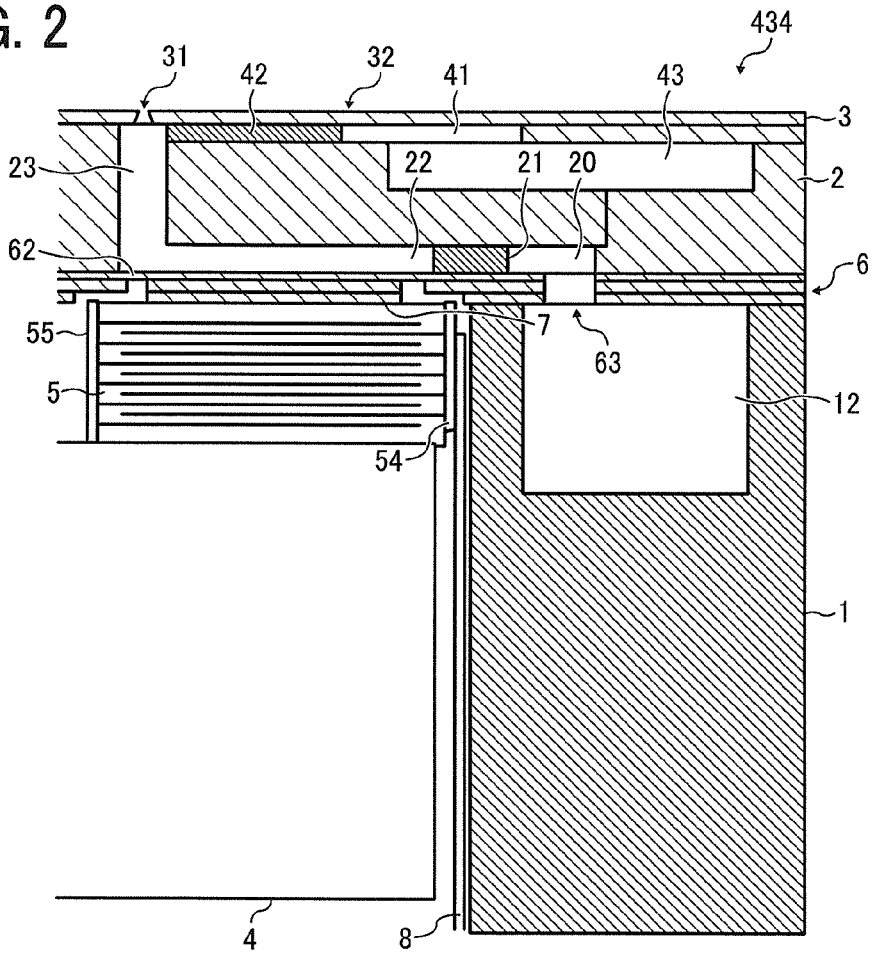
FIG. 2 is a cross-sectional view of a liquid discharge head according to an embodiment of the present disclosure, cut along a direction perpendicular to a nozzle array direction.
Figure 3:
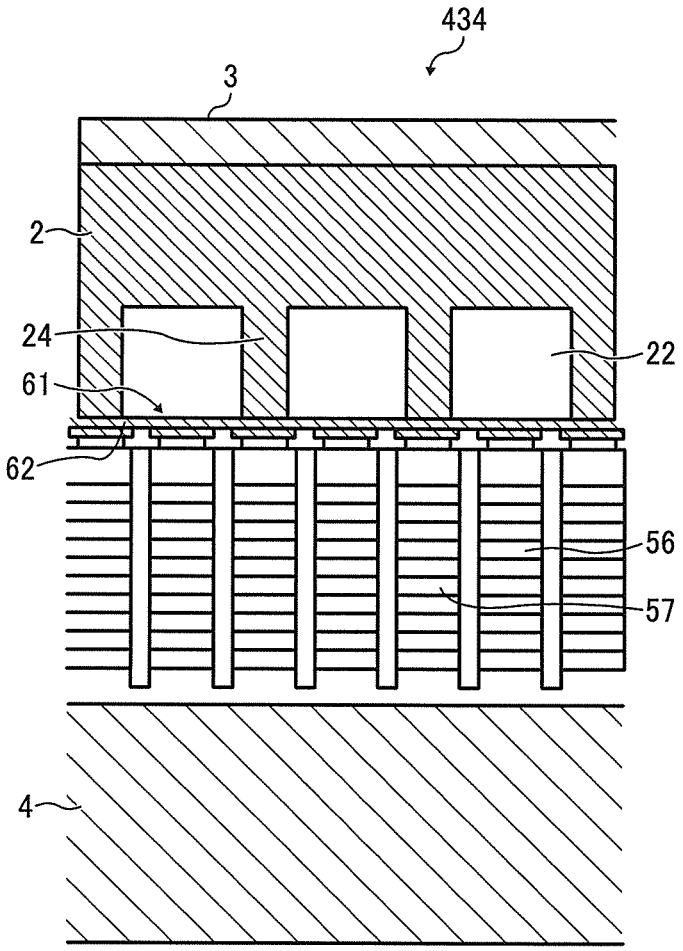
FIG. 3 is a cross-sectional view of the liquid discharge head of FIG. 2, cut along the nozzle array direction.
Figure 4:
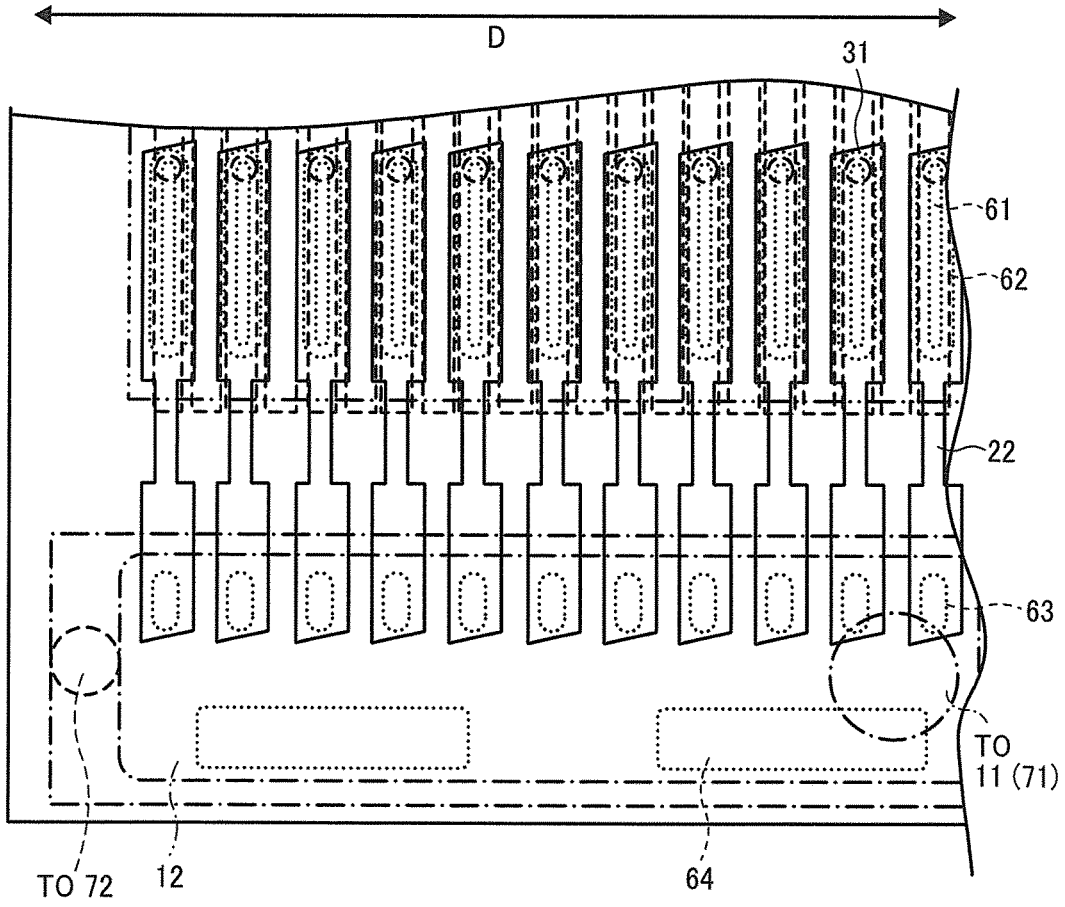
FIG. 4 is a cross-sectional view of the liquid discharge head of FIG. 2, cut along a planar direction of liquid chambers.

FIG. 2 is a cross-sectional view of a liquid discharge head 434 as a separately-circulating liquid discharge head according to an embodiment of the present disclosure, cut along a direction perpendicular to a nozzle array direction (indicated by arrow D in FIG. 4) in which nozzles are arrayed. FIG. 3 is a cross-sectional view of the liquid discharge head 434 cut along the nozzle array direction D. FIG. 4 is a cross-sectional view of the liquid discharge head 434 cut along a planar direction of liquid chambers.

The liquid discharge head 434 according to this embodiment includes a frame 1, fluid resistive portions 21, a channel plate 2, a nozzle pate 3, and a diaphragm plate 6. The frame 1 includes recessed portions as an ink supply port 11 (see FIG. 4) and a common liquid chamber 12. The channel plate 2 includes recessed portions as pressure generation chambers 22 and communication channels 23 communicated with nozzles 31. The nozzle pate 3 includes the nozzles 31. The diaphragm plate 6 includes island-shaped projections 61, diaphragm portions 62, and ink inlets 63. The liquid discharge head 434 further includes laminated piezoelectric elements 5 as pressure generating elements joined to the diaphragm plate 6 via an adhesion layer 7 and a base 4 to which the laminated piezoelectric elements 5 are secured.

The base 4 is made of barium titanate based ceramic. The laminated piezoelectric elements 5 are arrayed in two rows and joined to the base 4. In the laminated piezoelectric element 5, piezoelectric layers made of lead zirconate titanate (PZT), each having a thickness of from 10 μm to 50 μm per layer, and internal electrode layers made of silver-palladium (AgPd), each having a thickness of several μm per layer, are alternately laminated one on another. The internal electrode layers are connected to external electrodes. The laminated piezoelectric elements 5 are divided in a comb shape by half-cut dicing and alternately used as driving portions 56 and support portions 57 (non-driving portions). The outer side of the external electrodes is divided by half-cut dicing and the lengths thereof are limited by processing, e.g., notching to form a plurality of individual electrodes 54. The opposite side is conducting without being divided by dicing, to form a common electrode 55.

Flexible print circuits (FPC) 8 are soldered to the individual electrodes 54 of the driving portions 56. For the common electrode 55, an electrode layer is disposed at an end portion of the laminated piezoelectric elements 5 and is turned and joined to a ground (Gnd) electrode of the FPC 8. The FPC 8 is implemented with a head driver 109 as a head controller to control application of a drive voltage to the driving portions 56.

The diaphragm plate 6 is formed by laminating two layers of Ni plating films by electroforming. The diaphragm plate 6 includes thin-film diaphragm portions 62, island-shaped projections 61, thick-film portions, and openings as the ink inlets 63. The projection 61 is joined to the laminated piezoelectric element 5 as the driving portion 56 disposed at a central portion of the diaphragm portion 62. The thick-film portion includes a beam joined to the frame 1. The diaphragm portion 62 has a thickness of 3 μm and a width of 35 μm (one side). The island-shaped projection 61 of the diaphragm plate 6 and the driving portion (movable portion) of the laminated piezoelectric element 5 are adhered by patterning the adhesion layer 7 including a gap material. The diaphragm plate 6 and the frame 1 are also adhered by patterning the adhesion layer 7.

The channel plate 2 is formed by patterning the fluid resistive portions 21, recessed portions to be the pressure generation chambers 22, and through-holes to be the communication channel 23 at positions corresponding to the nozzles 31 by etching a monocrystalline silicon substrate. Remaining portions after etching form partitions 24 of the pressure generation chambers 22. For the liquid discharge head 434, the etching width is partially set smaller to form the fluid resistive portions 21.

The nozzle pate 3 is made of a metal material, for example, a Ni plating film formed by electroforming, and includes a large number of nozzles 31 that are fine discharge ports to fly ink droplets. The internal shape (interior shape) of the nozzle 31 is horn-shaped (or may be substantially cylindrical or substantially frustoconical). The diameter of the nozzle 31 at an exit side of ink droplet is approximately 20 μm to approximately 35 μm. The nozzle pitch of each nozzle row is 150 dots per inch (dpi).

A water-repellent layer 32 surface-treated for water repellency is disposed on an ink discharge face (a nozzle surface side) of the nozzle pate 3. The water-repellent layer 32 is formed by a treatment selected in accordance with the physical properties of ink from, for example, polytetrafluoroethylene (PTFE)-Ni eutectoid plating, electrodeposition of fluororesin, vapor deposition of exporative fluororesin (e.g., fluorinated pitch), firing after coating of a solution of silicon-based resin or fluorine-based resin. Accordingly, the droplet shape and flying properties are stabilized to obtain a high degree of image quality. The frame 1, in which recessed portions to be the ink supply port 11 and the common liquid chamber 12 are to be formed, is manufactured by resin molding.

For the liquid discharge head 434 thus configured, a drive waveform (a pulse voltage of from 10 V to 50 V) constituted of a drive pulse is applied to the driving portions 56 in accordance with a recording signal. Thus, the driving portions 56 are displaced in a direction of lamination of the driving portions 56 and the pressure generation chamber 22 is pressurized via the diaphragm plate 6 to increase pressure, discharging ink droplets from the nozzle 31. When the discharge of ink droplets ends, the pressure of ink in the pressure generation chamber 22 decreases. A negative pressure arises in the pressure generation chamber 22 due to the inertia of ink flow and the electric discharge process of drive voltage (drive pulse) and the process shifts to an ink refilling step. At this time, ink supplied from an ink tank flows into the common liquid chamber 12 and is refilled into the pressure generation chamber 22 from the common liquid chamber 12 through the ink inlet 63 and the fluid resistive portion 21.

The fluid resistive portion 21 is resistive against the refilled ink due to the surface tension while having an effect of decreasing residual pressure vibration after ink discharge.

By properly selecting the configuration of the fluid resistive portion 21, the decay of the residual pressure and the refilling time are balanced, thus allowing a reduction in a transition time (drive cycle) to the next ink-droplet discharge operation.

Next, an example of an ink circulation system using the liquid discharge head 434 according to this embodiment is described with reference to FIG. 5.

Figure 5:
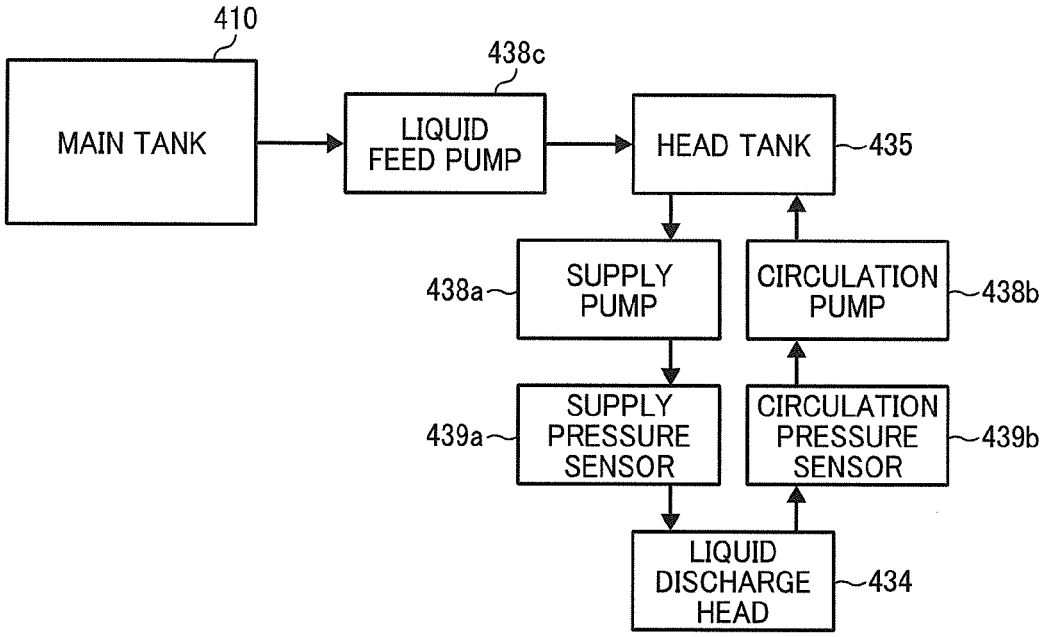
FIG. 5 is a block diagram of an ink circulation system according to an embodiment of the present disclosure.

FIG. 5 is a block diagram of the ink circulation system according to this embodiment. As illustrated in FIG. 5, the ink circulation system includes, e.g., a main tank 410, the liquid discharge head 434, a head tank 435, a supply pump 438*a*, a circulation pump 438*b*, a liquid feed pump 438*c*, a supply pressure sensor 439*a*, and a circulation pressure sensor 439*b*. The supply pressure sensor 439*a* is disposed between the supply pump 438*a* and the liquid discharge head 434 and connected to a supply channel connected to a supply port 71 (see FIG. 1) of the liquid discharge head 434. The circulation pressure sensor 439*b* is disposed between the liquid discharge head 434 and the circulation pump 438*b* and is connected to a circulation channel connected to a circulation port 72 (see FIG. 1) of the liquid discharge head 434. The supply pump 438*a* and the circulation pump 438*b* flow ink so that the supply pressure sensor 439*a* detects a positive pressure and the circulation pressure sensor 439*b* detects a negative pressure. Accordingly, ink flows from the head tank 435 into the liquid discharge head 434 via the supply port 71, exits from the circulation port 72, and returns to the head tank 435, thus allowing circulation of ink.

The supply pump 438*a* and the circulation pump 438*b* are constantly controlled so that the supply pressure sensor 439*a* detects a constant positive pressure and the circulation pressure sensor 439*b* detects a constant negative pressure. Such a configuration allows the menisci of ink to be maintained at a constant negative pressure while circulating ink through the inside of the liquid discharge head 434. When droplets are discharged from the nozzles 31 of the liquid discharge head 434, the amount of ink in the head tank 435 decreases.

Accordingly, the liquid feed pump 438*c* replenishes ink from the main tank 410 to the head tank 435. The replenishment of ink from the main tank 410 to the head tank 435 is controlled in accordance with a result of detection with, e.g., a liquid level sensor in the head tank 435, for example, in a manner in which ink is replenished when the liquid level of ink in the head tank 435 is lower than a predetermined height.

First Configuration Example

Next, a first configuration example of the liquid discharge head 434 is described below.

Figure 6:
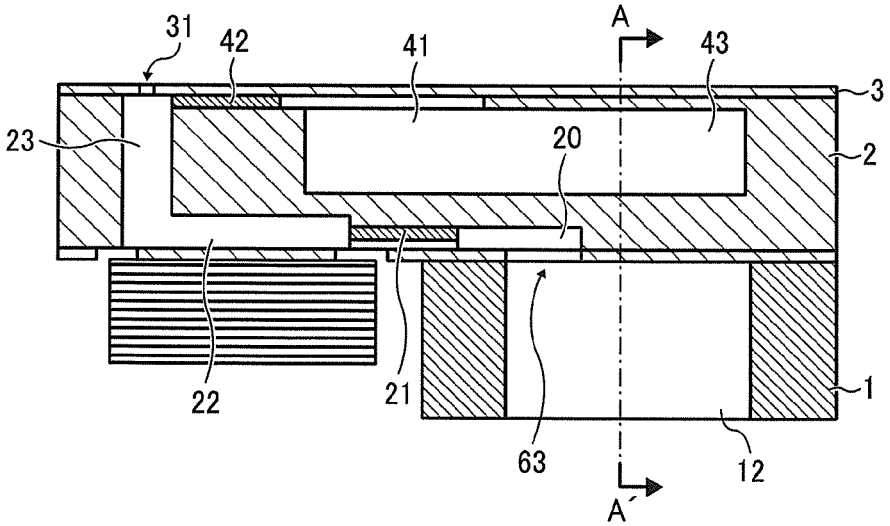
FIG. 6 is a cross-sectional view of a liquid discharge head according to an embodiment of the present disclosure, cut along the direction perpendicular to the nozzle array direction.

FIG. 6 is a cross-sectional view of the liquid discharge head 434 cut along a direction perpendicular to the nozzle array direction D (a longitudinal direction of the liquid discharge head 434). The circulation channel connects the common liquid chamber 12 to a common circulation channel 41 through an introduction portion 20, the fluid resistive portion 21, the pressure generation chamber 22, the communication channel 23, and a circulation resistive portion 42. The nozzle 31 is disposed at an end of the communication channel 23 in a course of the circulation channel. The common liquid chamber 12 is disposed in the frame 1 and a channel from the introduction portion 20 to the circulation channel 41 is disposed in the channel plate 2. The channel plate 2 has a configuration in which a plurality of plate members are laminated.

FIG. 1 is an example of a cross-sectional view of the liquid discharge head 434 cut along line A-A' of FIG. 6. The supply port 71 of the frame 1 is communicated with the common liquid chamber 12 and the supply port 71 is disposed at a center of the common liquid chamber 12 in the nozzle array direction D. The common liquid chamber 12 is communicated with a circulation liquid chamber 43 in the channel plate 2 via the circulation channel described with reference to FIG. 6 and connected to the circulation port 72. As illustrated in FIG. 1, two circulation ports 72 are disposed at both sides of the frame 1 outer than the common liquid chamber 12 in the nozzle array direction D. The arrangement of the supply port 71 and the circulation ports 72 at the above-described positions allows a smaller width of the liquid discharge head 434 in the liquid discharge head 434 than a configuration in which the supply port 71 is disposed an end portion of the common liquid chamber 12 in the nozzle array direction D while the circulation port 72 are disposed at the same positions.

Accordingly, the arrangement allows the circulation channel to be formed while preventing an increased size of the liquid discharge head 434 in the nozzle array direction D. The arrangement of the supply port 71 at the center of the common liquid chamber 12 in the nozzle array direction D also allows the length of a liquid channel from the supply port 71 to each circulation port 72 to be the same in any of the pressure generation chambers 22. As described above, setting the liquid channel to the same length in any of the pressure generation chambers 22 allows a sum of a pressure loss arising in the common liquid chamber 12 and a pressure loss arising in the circulation liquid chamber 43 to be the same in a route through any of the pressure generation chambers 22. Setting the sum of the pressure loss to the same prevents the occurrence of a difference in properties due to pressure loss.

Second Configuration Example

Next, a second configuration example of the liquid discharge head 434 is described below.

Figure 7:
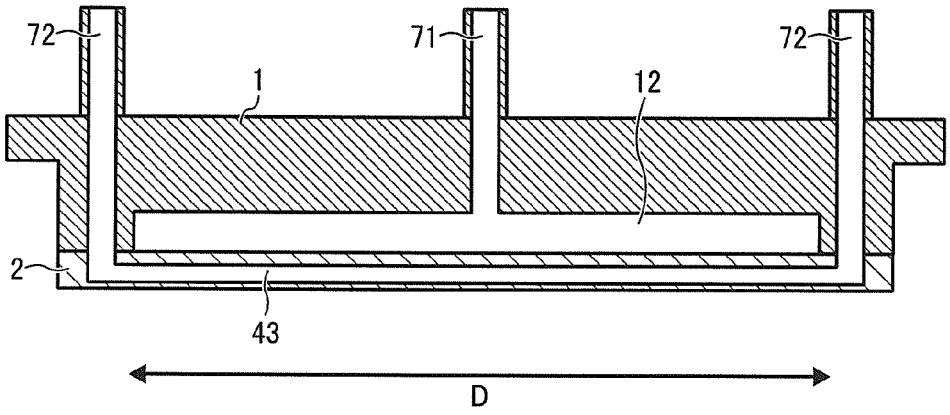
FIG. 7 is a cross-sectional view of another example of a liquid discharge head cut along line A-A' of FIG. 6.

FIG. 7 is a cross-sectional view of another example of the liquid discharge head 434 cut along line A-A' of FIG. 6. Like FIG. 1, the supply port 71 of the frame 1 is communicated with the common liquid chamber 12 and the supply port 71 is disposed at the center of the common liquid chamber 12 in the nozzle array direction D (the longitudinal direction of the liquid discharge head 434). The common liquid chamber 12 is communicated with a circulation liquid chamber 43 in the channel plate 2 via the circulation channel described with reference to FIG. 6 and connected to the circulation port 72. As illustrated in FIG. 7, two circulation ports 72 are disposed at both sides of the frame 1 outer than the common liquid chamber 12 in the nozzle array direction D.

For the liquid discharge head 434 according to the second configuration example, a cross-sectional area of the common liquid chamber 12 in a direction perpendicular to a direction of flow of liquid is greater than a cross-sectional area of the circulation liquid chamber 43 in the direction perpendicular to the direction of flow of liquid. The common liquid chamber 12 has a fluid resistance smaller than the circulation liquid chamber 43. For such a configuration, when liquid is discharged while circulated, both liquid for circulation and liquid for discharge flow through the common liquid chamber 12. However, the cross-sectional area of the common liquid chamber 12 is greater than the cross-sectional area of the circulation liquid chamber 43, thus reducing pressure loss in the common liquid chamber 12.

For example, assume that, when liquid is circulated from the supply port 71 to the circulation port 72 at the flow amount of 400 μl/s, a greatest discharge amount of liquid from all the nozzles 31 of the liquid discharge head 434 is 200 μl/s. Since liquid to be discharged from all the nozzles 31 of the liquid discharge head 434 is supplied from the common liquid chamber 12, a greatest flow amount of liquid flowing to the supply port 71 and the common liquid chamber 12 is 600 μl/s and a greatest flow amount of liquid flowing to the circulation liquid chamber 43 and the circulation port 72 is 400 μl/s. At maximum, liquid flows in the common liquid chamber 12 at a flow amount of 1.5 times as great as the greatest flow amount of liquid in the circulation liquid chamber 43 Accordingly, the cross-sectional area of the common liquid chamber 12 is preferably not smaller than 1.5 times as great as the cross-sectional area of the circulation liquid chamber 43.

Third Configuration Example

Next, a third configuration example of the liquid discharge head 434 is described below.

For the liquid discharge head 434 according to the above-described second configuration example, the cross-sectional area of the common liquid chamber 12 in the direction perpendicular to the direction of flow of liquid is greater than the cross-sectional area of the circulation liquid chamber 43 in the direction perpendicular to the direction of flow of liquid to reduce the fluid resistance value of the channel. By contrast, even when the cross-sectional area of the common liquid chamber 12 in the direction perpendicular to the direction of flow of liquid is smaller than the cross-sectional area of the circulation liquid chamber 43 in the direction perpendicular to the direction of flow of liquid, the fluid resistance value of the channel may be small, depending on the shape of the channel. For example, when the aspect ratio of the width to the height of the channel is high, the channel has a relatively high fluid resistance value even if the common liquid chamber 12 and the circulation liquid chamber 43 have the same cross-sectional area. Accordingly, as the aspect ratio of the width to the height of the channel is closer to one, the fluid resistance value of the channel is smaller even if the common liquid chamber 12 and the circulation liquid chamber 43 have the same cross-sectional area. As described above, setting the fluid resistance value of the common liquid chamber 12 to be smaller than the fluid resistance value of the circulation liquid chamber 43 reduces pressure loss due to flow of liquid for circulation and liquid for discharge.

For example, relative to the channel having an aspect ratio of 1:1 in cross section, it is necessary to increase the width to approximately 100 times to obtain the same fluid resistance value by half of the height. That is, the aspect ratio is 200. Like the above-described second configuration example, assuming that liquid flows at a flow amount of 600 μl/s in the common liquid chamber 12 and at a flow amount of 400 μl/s is in the circulation liquid chamber 43, the fluid resistance value of the common liquid chamber 12 is preferably set to be not greater than two third of the fluid resistance value of the circulation liquid chamber 43. When the aspect ratio of the common liquid chamber 12 in cross section is 1:1 and the aspect ratio of the circulation liquid chamber 43 in cross section is 0.6:1.8, the fluid resistance value of the common liquid chamber 12 is approximately two third of the fluid resistance value of the circulation liquid chamber 43 and the cross-sectional area of the common liquid chamber 12 is approximately 91% of the cross-sectional area of the circulation liquid chamber 43. As described above, it is necessary to consider the fluid resistance value rather than the cross-sectional area, depending on the cross-sectional shape of the channel.

Note that, in the above-described embodiment, the configurations of the channel components are described taking several examples. However, the configurations of the channel components are not limited to the above-described embodiment. Generally, an inkjet recording apparatus including a droplet discharge head to discharge, for example, droplets of ink (hereinafter, referred to as ink droplets) is known as a printer, a fax machine, a copier, a plotter, or an image forming apparatus obtained by combining functions of these devices. In the inkjet recording apparatus, ink droplets are adhered to a sheet of paper as a recording medium by a droplet discharge head while the medium is conveyed and an image is formed. In this disclosure, the medium used herein is also referred to as a "sheet." However, the medium is not limited to a specific material and a recording medium, a transfer material, and a recording sheet may be used. In addition, the image forming apparatus means an apparatus that applies droplets to a medium such as a sheet, thread, fiber, cloth, hides, metal, plastic, glass, wood, and ceramics and forms an image. In addition, the image formation means applying an image not having the meaning such as a pattern (discharging the droplets simply) as well as applying an image having the meaning such as a letter or a figure to the medium. In addition, the ink is used. However, the present disclosure is not limited to the ink and any material becoming a droplet at the time of being discharged may be used. The ink is used as a general term of liquids including a DNA sample, a resist, and a pattern material.

Second Embodiment

A second embodiment is described below.

Figure 8:
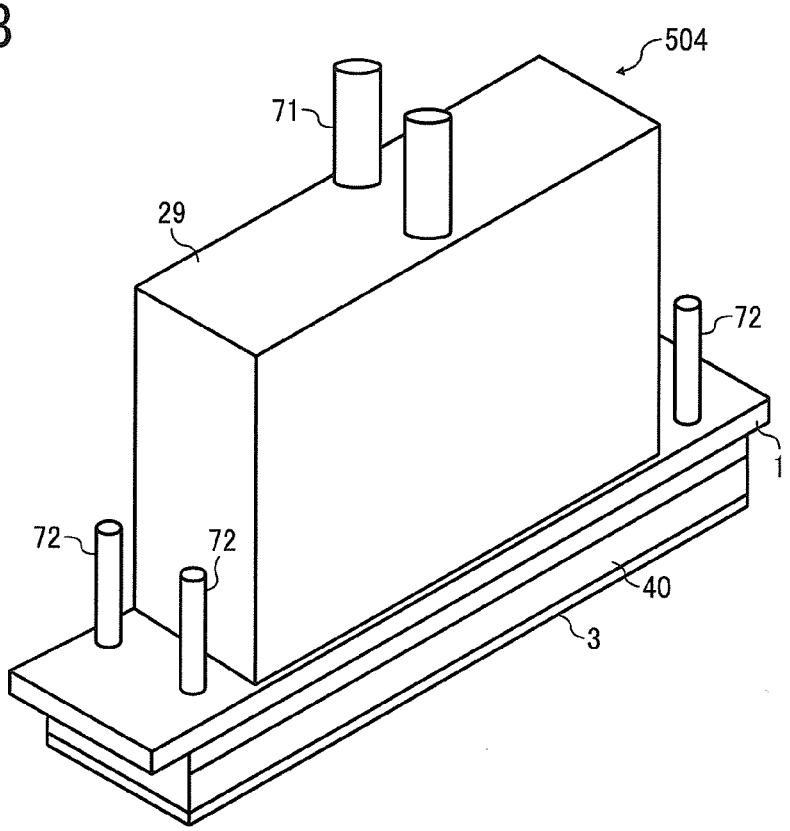
FIG. 8 is an outer perspective view of a liquid discharge head according to a second embodiment of the present disclosure.
Figure 9:
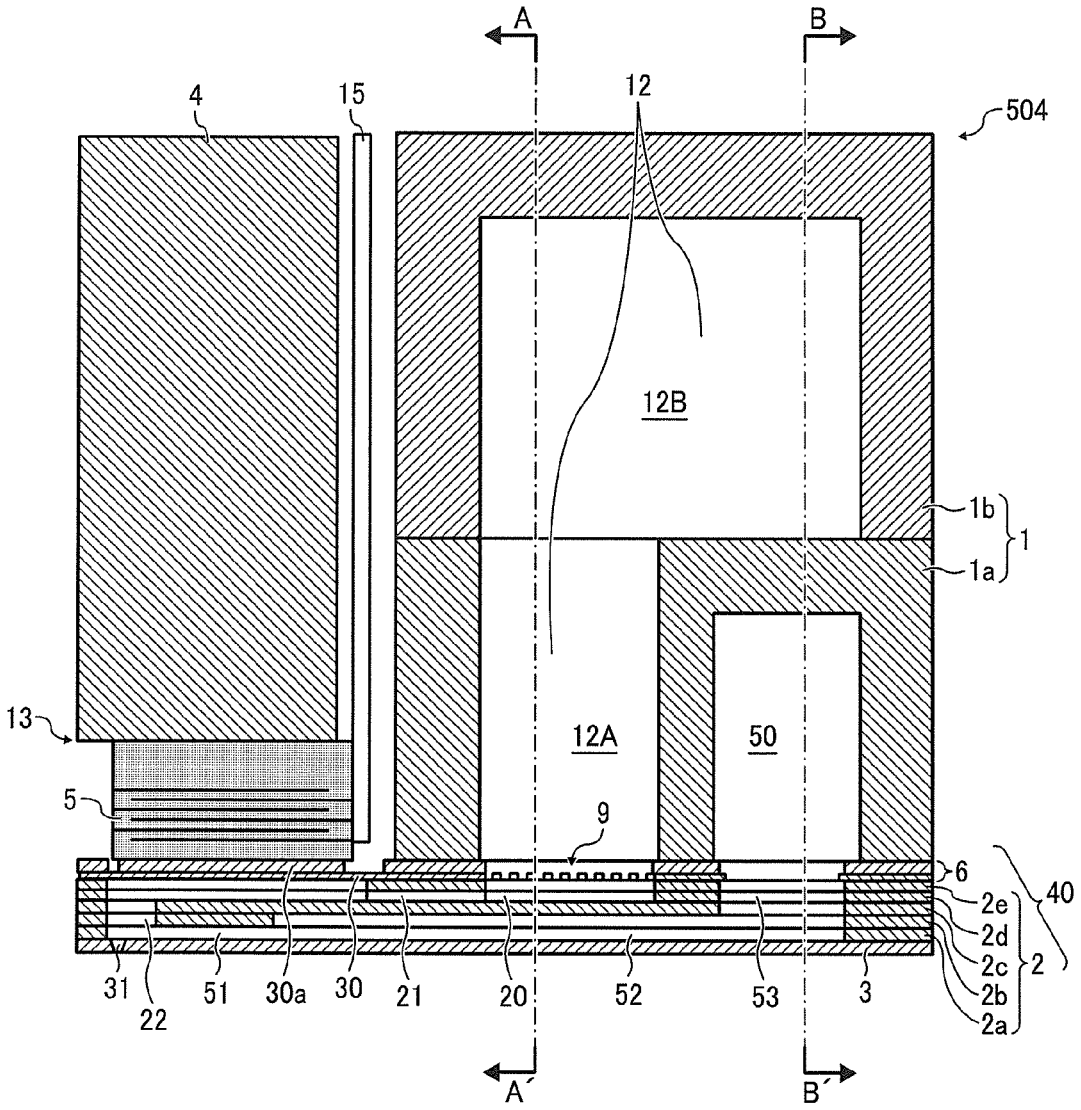
FIG. 9 is a cross-sectional view of the liquid discharge head of FIG. 8 cut along a direction perpendicular to a nozzle array direction.
Figure 10:
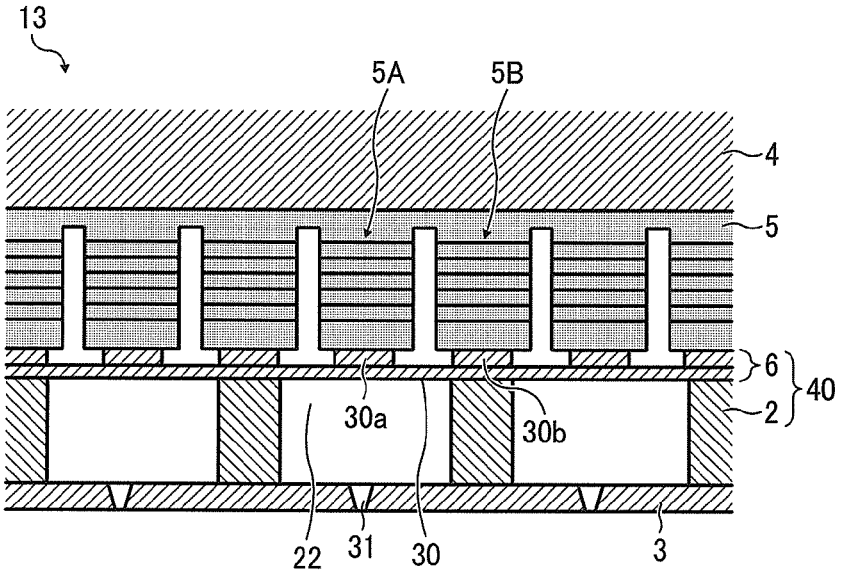
FIG. 10 is a partially cross-sectional view of the liquid discharge head of FIG. 8 cut along a direction parallel to a nozzle array direction.
Figure 11:
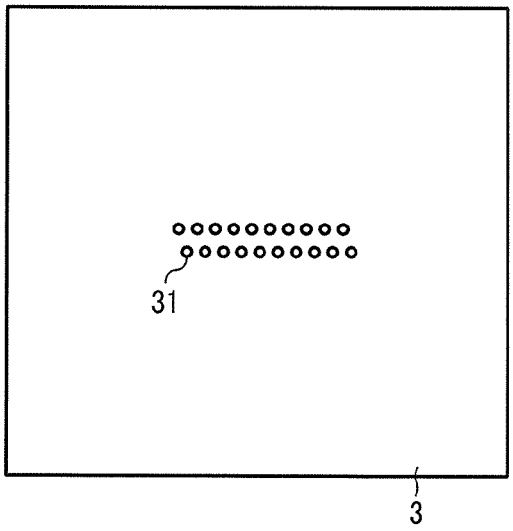
FIG. 11 is a plan view of a nozzle plate of the liquid discharge head of FIG. 8.

An example of a liquid discharge head 504 according to this second embodiment is described with reference to FIGS. 8 to 13. FIG. 8 is an outer perspective view of the liquid discharge head 504 according to this embodiment. FIG. 9 is a cross-sectional view of the liquid discharge head 504 according to this embodiment in a direction perpendicular to the nozzle array direction. FIG. 10 is a cross-sectional view of the liquid discharge head 504 according to this embodiment in a direction parallel to the nozzle array direction. FIG. 11 is a plan view of a nozzle plate 3 of the liquid discharge head 504 according to this embodiment. FIGS. 12A through 12F are plan views of members constituting a channel substrate of the liquid discharge head 504 according to this embodiment. FIGS. 13A and 13B are plan views of a common liquid chamber substrate of the liquid discharge head 504 according to this embodiment.

In the liquid discharge head 504, a nozzle pate 3, a channel plate 2, and a diaphragm plate 6 as a wall face substrate are joined and laminated one on another. The liquid discharge head 504 includes piezoelectric actuators 13 to displace the diaphragm plate 6, a frame 1 as a common liquid chamber substrate, and a cover 29. The nozzle pate 3 includes a plurality of nozzles 31 to discharge liquid. As illustrated in FIG. 11, the nozzles 31 are arranged in a staggered manner. The channel plate 2 includes pressure generation chambers 22 as individual liquid chambers communicated with the nozzles 31, fluid resistive portions 21 communicated with the pressure generation chambers 22, and introduction portions 20 communicated with the fluid resistive portions 21. In the channel plate 2, a plurality of plate members 2*a*, 2*b*, 2*c*, 2*d*, and 2*e* is joined and laminated one on another in this order from the side of the nozzle pate 3. The diaphragm plate 6 is joined and laminated on the plate members 2*a*, 2*b*, 2*c*, 2*d*, and 2*e* to constitute a channel member 40.

The diaphragm plate 6 includes filter portions 9 as openings to communicate the introduction portions 20 with a common liquid chamber 12 of the frame 1. The diaphragm plate 6 is a wall face substrate constituting wall faces of the pressure generation chambers 22 of the channel plate 2. The diaphragm plate 6 has a two-layer structure including a first layer including thin portions and facing the channel plate 2 and a second layer including thick portions. The first layer includes deformable vibration regions 30 at positions corresponding to the pressure generation chamber 22. Note that the diaphragm plate 6 is not limited to the two-layer structure.

Figure 12A:
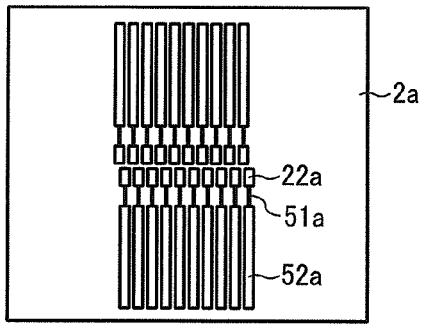
FIGS. 12A through 12F are plan views of members constituting a channel substrate of the liquid discharge head of FIG. 8.
Figure 12B:
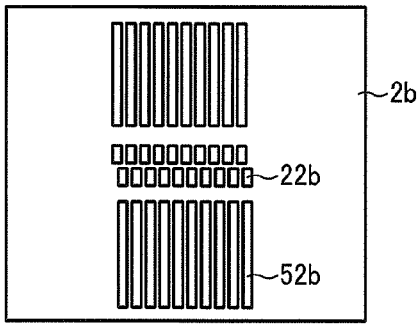
Figure 12C:
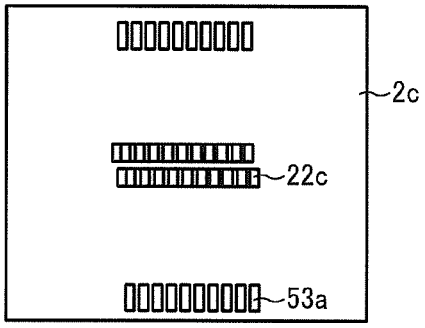
Figure 12D:
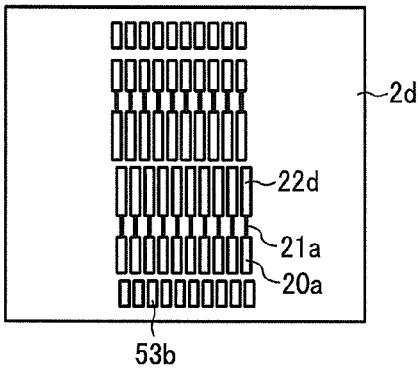
Figure 12E:
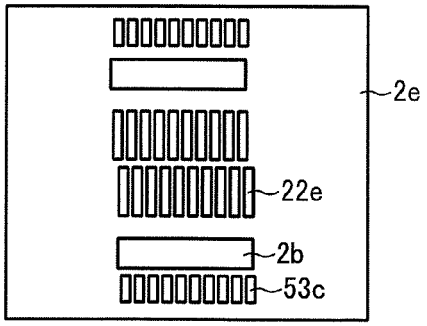
Figure 12F:
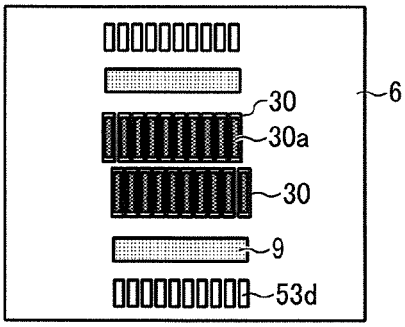
Figure 13A:
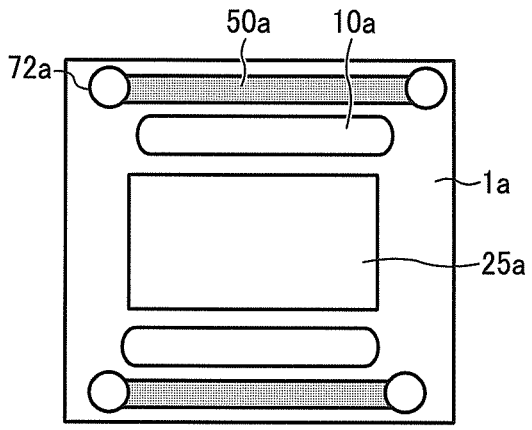
FIGS. 13A and 13B are plan views of a common liquid chamber substrate of the liquid discharge head of FIG. 8.
Figure 13B:
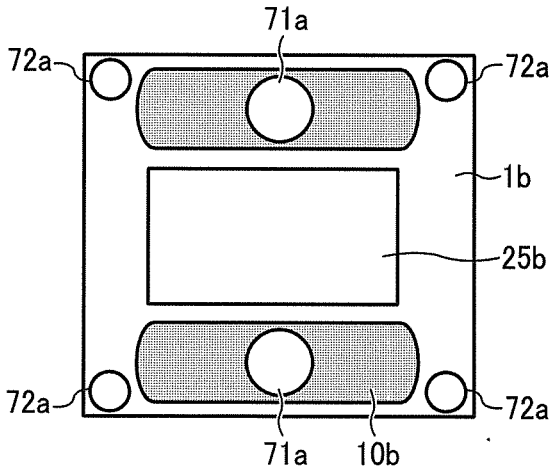

As illustrated in FIG. 12A, the plate member 2*a* constituting the channel plate 2 includes through grooves (groove-shaped through holes) 22*a* constituting the pressure generation chambers 22, fluid resistance portions 51, and through grooves 51*a* and 52*a* constituting circulation liquid chambers 43. As illustrated in FIG. 12B, the plate member 2*b* includes through grooves 22*b* constituting the pressure generation chambers 22 and through grooves 52*b* constituting circulation liquid chambers 43. As illustrated in FIG. 12C, the plate member 2*c* includes through grooves 22*c* constituting the pressure generation chambers 22 and through grooves 53*a* constituting circulation channels 53 and extending in a longitudinal direction parallel to the nozzle array direction. As illustrated in FIG. 12D, the plate member 2*d* includes through grooves 22*d* constituting the pressure generation chambers 22, through grooves 21*a* as the fluid resistive portions 21, through grooves 20*a* constituting the introduction portions 20, and through grooves 53*b* constituting the circulation channels 53 and extending in a longitudinal direction parallel to the nozzle array direction. As illustrated in FIG. 12E, the plate member 2*e* includes through grooves 22*e* constituting the pressure generation chambers 22, through grooves as filter-downstream-side chambers constituting the introduction portions 20 and extending in a longitudinal direction parallel to the nozzle array direction, and through grooves 53*c* constituting the circulation channels 53 and extending in a longitudinal direction parallel to the nozzle array direction. As illustrated in FIG. 12F, the diaphragm plate 6 includes vibration regions 30, filter portions 9, through grooves 53*d* constituting the circulation channels 53 and extending in a longitudinal direction parallel to the nozzle array direction. As described above, the plate members 2*a*, 2*b*, 2*c*, 2*d*, and 2*e* are joined and laminated one on another to constitute the channel member 40, thus allowing formation of complicated channels with a simple configuration.

In the above-described configuration, the channel member 40 made of the channel plate 2 and the diaphragm plate 6 includes the fluid resistance portions 51 communicated with the pressure generation chamber 22 and extending in a plane direction of the channel plate 2, the circulation liquid chamber 43, and the circulation channels 53 communicated with the circulation liquid chamber 43 and extending in a thickness direction of the channel member 40. Note that the circulation channels 53 are communicated with the common liquid chambers 50 described below.

The frame 1 includes the common liquid chamber 12, to which liquid is supplied from a supply circulation device 594, and circulation common liquid chambers 50. As illustrated in FIG. 13A, a first common liquid chamber substrate la constituting the frame 1 includes a through hole 25*a* for piezoelectric actuator, through grooves 10*a* to be downstream common liquid chambers 12A, and grooves 50*a* with bottoms to be the circulation common liquid chambers 50. Likewise, as illustrated in FIG. 13B, a second common liquid chamber substrate lb includes a through hole 25*b* for piezoelectric actuator and grooves 10*b* to be upstream common liquid chambers 12B.

The second common liquid chamber substrate lb includes through holes 71*a* as supply port portions to communicate a center portion of the common liquid chamber 12 in the nozzle array direction with the supply ports 71 (see FIG. 8). Likewise, each of the first common liquid chamber substrate la and the second common liquid chamber substrate lb includes through holes 72*a* to communicate each end of the circulation common liquid chambers 50 in the nozzle array direction and the circulation port 72. Note that, in FIGS. 13A and 13B, the grooves with bottoms are illustrated in solid gray.

As described above, the frame 1 is made of the first common liquid chamber substrate 1*a* and the second common liquid chamber substrate 1*b*. The first common liquid chamber substrate 1*a* is joined to the diaphragm plate 6 of the channel member 40. The second common liquid chamber substrate lb is joined and laminated on the first common liquid chamber substrate la. The frame 1 includes the common liquid chamber 12, to which liquid is supplied from a head tank or liquid cartridge, and the circulation common liquid chambers 50.

Here, the first common liquid chamber substrate la includes the downstream common liquid chamber 12A constituting part of the common liquid chamber 12 communicated with the introduction portions 20 and the circulation common liquid chambers 50 communicated with the circulation channels 53. The second common liquid chamber substrate 1*b* includes the upstream common liquid chamber 12B which is a remaining portion of the common liquid chamber 12. At this time, the downstream common liquid chamber 12A constituting part of the common liquid chamber 12 and the circulation common liquid chambers 50 are arranged side by side in a direction perpendicular to the nozzle array direction. The circulation common liquid chambers 50 are disposed at positions at which the circulation common liquid chambers 50 are projected in the common liquid chamber 12. Such a configuration prevents the dimension of the circulation common liquid chambers 50 from being constrained by a dimension required for a channel including the pressure generation chambers 22, the fluid resistive portions 21, and the introduction portions 20 of the channel member 40. As described above, the circulation common liquid chambers 50 and the common liquid chamber 12 are partially arranged side by side and the circulation common liquid chambers 50 are disposed at the positions at which the circulation common liquid chambers 50 are projected in the common liquid chamber 12. Such a configuration prevents an increase in the width of the liquid discharge head 504 in the direction perpendicular to the nozzle array direction. Accordingly, the upsizing of the liquid discharge head 504 is prevented.

Piezoelectric actuators 13 including electromechanical transducer elements as driving devices to deform the vibration regions 30 of the diaphragm plate 6 are disposed at a side of the diaphragm plate 6 opposite the pressure generation chambers 22. As illustrated in FIG. 10, the piezoelectric actuator 13 includes the laminated piezoelectric element 5 joined to the base 4. For the laminated piezoelectric element 5, a single laminated piezoelectric element 5 is groove-processed by half-cut dicing, so that a desired number of pillar-shaped piezoelectric elements 5A and 5B are formed in a comb shape at predetermined distances.

In this embodiment, the piezoelectric element 5A of the laminated piezoelectric element 5 is a piezoelectric element to be driven by a drive waveform applied and a piezoelectric element 5B is a simple support to which a drive waveform is not applied. However, in some embodiments, all the piezoelectric elements 5A and 5B may be piezoelectric elements to be driven by application of drive waveforms. The piezoelectric elements 5A are joined to projections 30*a* as island-shaped thick portions in the vibration regions 30 of the diaphragm plate 6. The piezoelectric elements 5B are joined to projections 30*b* as thick portions of the diaphragm plate 6. The laminated piezoelectric element 5 includes piezoelectric layers and internal electrodes alternately laminated. The internal electrodes are lead out to end faces of the laminated piezoelectric element 5 to form external electrodes. The external electrodes are connected to a flexible wire member 15.

In the liquid discharge head 504 thus configured, for example, when the voltage applied to the piezoelectric element 5A is lowered from a reference potential, the piezoelectric element 5A contracts. As a result, the vibration region 30 of the diaphragm plate 6 moves downward and the volume of the pressure generation chamber 22 increases, thus causing liquid to flow into the pressure generation chamber 22. When the voltage applied to the piezoelectric element 5A is raised, the piezoelectric element 5A expands in the direction of lamination. The vibration region 30 of the diaphragm plate 6 deforms in a direction toward the nozzle 31 and contracts the volume of the pressure generation chamber 22. Thus, liquid in the pressure generation chamber 22 is pressurized and discharged from the nozzle 31. Then, liquid is drawn from the common liquid chamber 12 by surface tension and is refilled into the common liquid chamber 12. Finally, the meniscus surface of liquid is stabilized by a balance between a negative pressure determined by a supply tank 531, a circulation tank 532, and a hydraulic head difference and a surface tension of the meniscus, thus allowing a transition to the next discharge operation.

Note that the driving method of the liquid discharge head 504 is not limited to the above-described example (pull-push discharge). For example, pull discharge or push discharge may be performed by changing the way of applying the drive waveform. In the above-described embodiment, the laminated piezoelectric element is described as an example of the pressure generator to apply pressure fluctuations to the pressure generation chamber 22. However, the pressure generator is not limited to the laminated piezoelectric element and may be, for example, a thin-film piezoelectric element. In some embodiments, a thermal resistor may be disposed within the pressure generation chamber 22 to heat liquid to generate bubbles to apply pressure fluctuations. Alternatively, for example, pressure fluctuations may be generated by electrostatic force.

Next, an example of a liquid circulation system 530 using the liquid discharge head 504 according to this embodiment is described with reference to FIG. 14.

Figure 14:
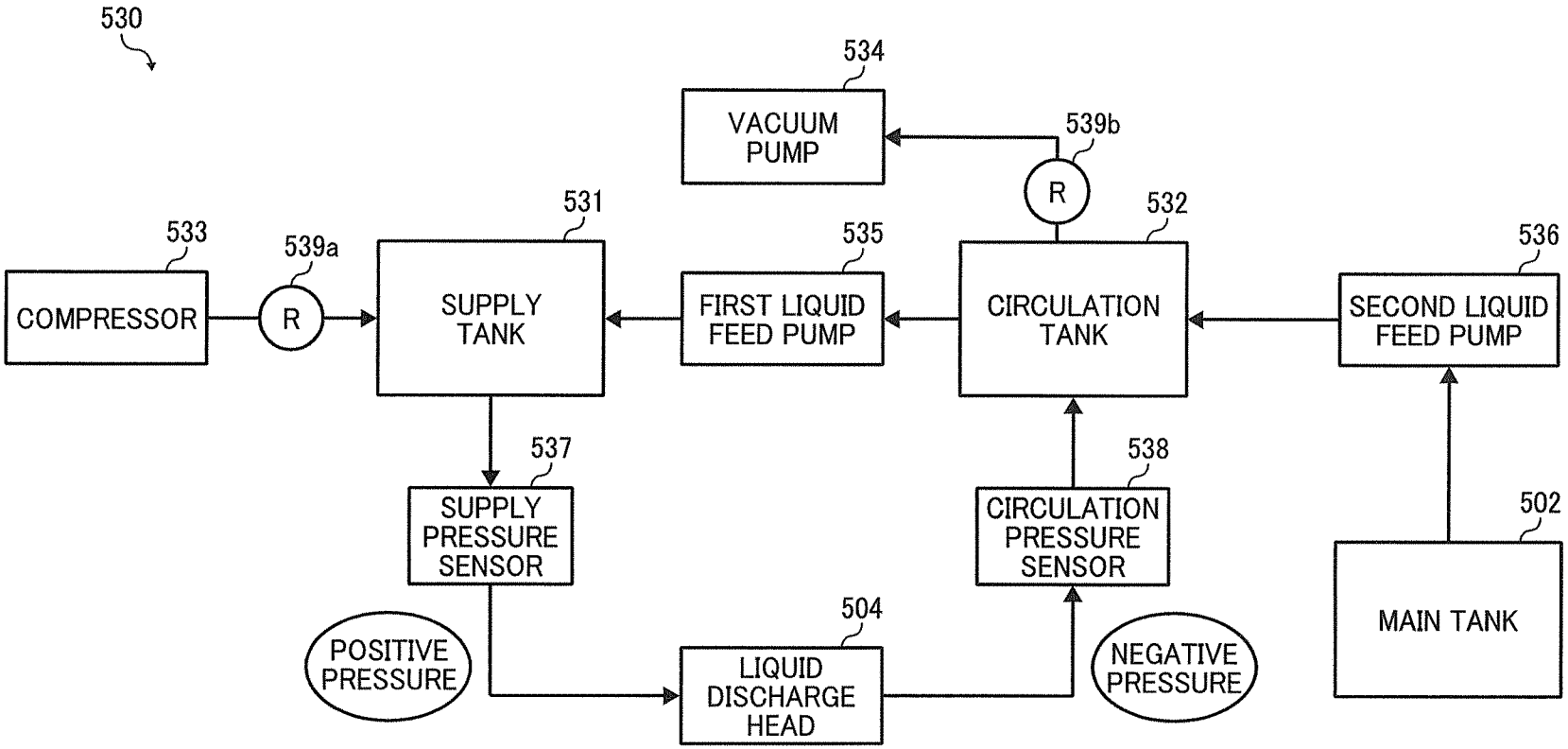
FIG. 14 is a block diagram of an example of the liquid circulation system in the second embodiment.

FIG. 14 is a block diagram of the liquid circulation system 530 according to this embodiment. As illustrated in FIG. 14, the liquid circulation system 530 includes, e.g., a main tank 502, the liquid discharge head 504, a supply tank 531, a circulation tank 532, a compressor 533, a vacuum pump 534, a first liquid feed pump 535, a second liquid feed pump 536, a supply pressure sensor 537, a circulation pressure sensor 538, a regulator (R) 539*a*, and a regulator (R) 539*b*. The supply pressure sensor 537 is disposed between the supply tank 531 and the liquid discharge head 504 and connected to a supply channel connected to the supply port 71 (see FIG. 8) of the liquid discharge head 504. The circulation pressure sensor 538 is disposed between the liquid discharge head 504 and the circulation tank 532 and is connected to a circulation channel connected to the circulation port 72 (see FIG. 8) of the liquid discharge head 504.

One end of the circulation tank 532 is connected to the supply tank 531 via the first liquid feed pump 535 and the other end of the circulation tank 532 is connected to the main tank 502 via the second liquid feed pump 536. Thus, liquid is flown from the supply tank 531 into the liquid discharge head 504 through the supply port 71 and output to the circulation tank 532 from the circulation port 72. Further, the first liquid feed pump 535 feeds liquid from the circulation tank 532 to the supply tank 531, thus circulating liquid. The supply tank 531 is connected to the compressor 533 and controlled so that a predetermined positive pressure is detected with the supply pressure sensor 537. By contrast, the circulation tank 532 is connected to the vacuum pump 534 and controlled so that a predetermined negative pressure is detected with the circulation pressure sensor 538. Such a configuration allows the menisci of ink to be maintained at a constant negative pressure while circulating ink through the inside of the liquid discharge head 504.

When droplets are discharged from the nozzles 31 of the liquid discharge head 504, the amount of liquid in each of the supply tank 531 and the circulation tank 532 decreases. Accordingly, preferably, liquid is replenished from the main tank 502 to the circulation tank 532 with the second liquid feed pump 536. The replenishment of liquid from the main tank 502 to the circulation tank 532 is controlled in accordance with a result of detection with, e.g., a liquid level sensor in the circulation tank 532, for example, in a manner in which liquid is replenished when the liquid level of liquid in the circulation tank 532 is lower than a predetermined height.

Next, the circulation of liquid in the liquid discharge head 504 is described below.

Figure 15:
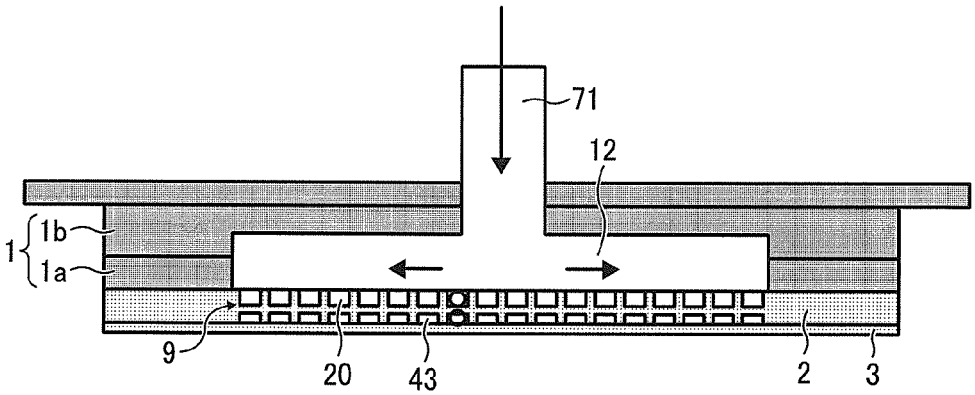
FIG. 15 is a cross-sectional view of the liquid discharge head cut along line A-A' of FIG. 9.
Figure 16:
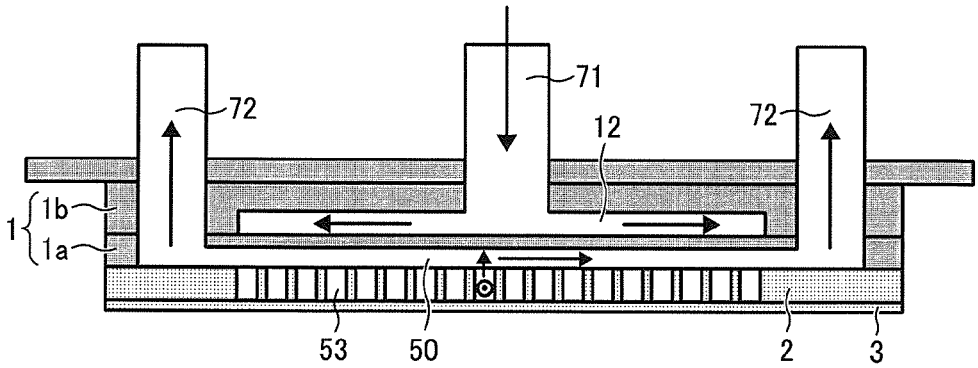
FIG. 16 is a cross-sectional view of the liquid discharge head cut along line B-B' of FIG. 9.

FIG. 15 is a cross-sectional view of the liquid discharge head 504 cut along line A-A' of FIG. 9. FIG. 16 is a cross-sectional view of the liquid discharge head 504 cut along line B-B' of FIG. 9. As illustrated in FIG. 8, the liquid discharge head 504 includes the supply port 71 and the circulation ports 72 at an end portion of the frame 1. The supply port 71 is communicated with the common liquid chamber 12. The circulation port 72 is communicated with the circulation common liquid chambers 50. The supply port 71 and the circulation ports 72 are connected to the supply tank 531 and the circulation tank 532 (see FIG. 14), respectively, via tubes. Liquid stored in the supply tank 531 is supplied to the pressure generation chambers 22 via the supply port 71, the common liquid chamber 12, the introduction portions 20, and the fluid resistive portions 21. Liquid in the pressure generation chamber 22 is discharged from the nozzles 31 by driving the piezoelectric elements 5A and 5B. Meanwhile, a portion or all of liquid stored in the pressure generation chambers 22 without being discharged is circulated to the circulation tank 532 through the fluid resistance portions 51, the circulation channels 52 and 53, the circulation common liquid chambers 50, and the circulation ports 72.

Note that the circulation of liquid can be performed not only during operation of the liquid discharge head 504 but also during the suspension of operation. Circulation during the suspension of operation reduces aggregation and sedimentation of components of liquid while constantly refreshing liquid in the pressure generation chambers 22.

In this embodiment, the liquid discharge head 434 may be employed that has any configuration of the first to third configuration examples of the first embodiment described with reference to, e.g., FIGS. 1, 6, and 7, thus giving advantages equivalent to the above-described advantages. In such a configuration, the liquid discharge head is downsized, thus allowing the size of a liquid discharge apparatus including the liquid discharge head.

Figure 17:
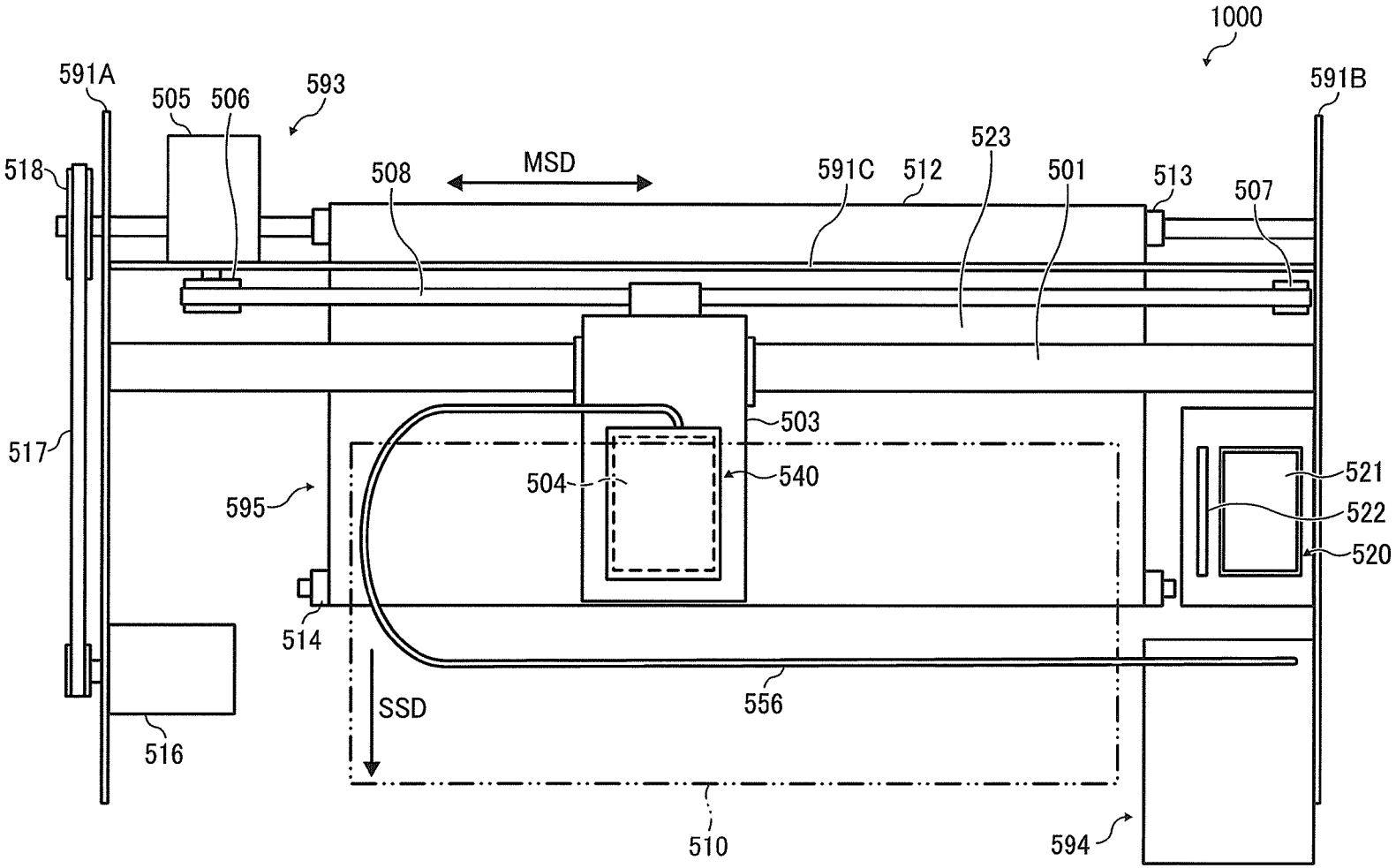
FIG. 17 is a plan view of a portion of a liquid discharge apparatus according to an embodiment of the present disclosure.

Next, an example of the liquid discharge apparatus 1000 in which the liquid discharge head 434 or 504 according to each of the above-described embodiment is usable is described with reference to FIGS. 17 and 18. Note that, in the example illustrated in FIGS. 17 and 18, the liquid discharge head 504 is used in the liquid discharge apparatus 1000. FIG. 17 is a plan view of a portion of the liquid discharge apparatus 1000 according to this embodiment.

Figure 18:
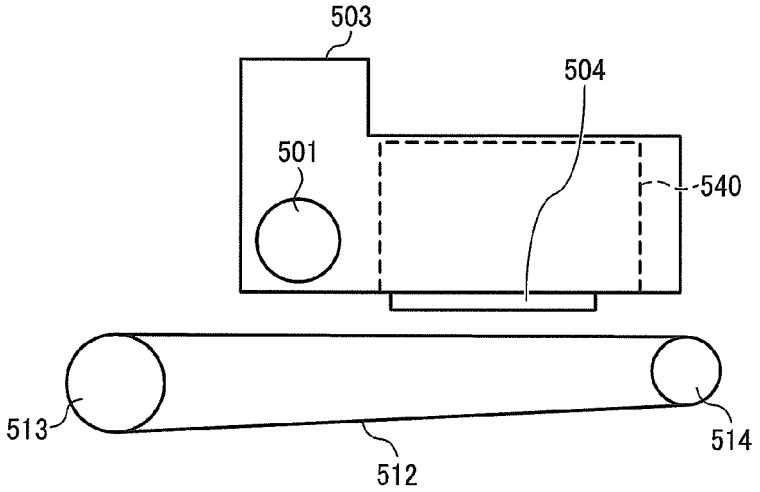
FIG. 18 is a side view of a portion of the liquid discharge apparatus of FIG. 17.

FIG. 18 is a side view of a portion of the liquid discharge apparatus 1000 according to this embodiment. The liquid discharge apparatus 1000 is a serial discharge apparatus and includes a main-scanning moving device 593 to reciprocally move a carriage 503 in a main scanning direction indicated by arrow MSD. The main-scanning moving device 593 includes, e.g., a guide 501, a main scanning motor 505, and a timing belt 508. The guide 501 is laterally bridged between side plates 591A and 591B at both ends in a longitudinal direction of the liquid discharge apparatus 1000 and supports the carriage 503 in a manner in which carriage 503 is movable. The main scanning motor 505 reciprocally moves the carriage 503 in the main scanning direction MSD, which is the longitudinal direction of the liquid discharge apparatus 1000, via the timing belt 508 laterally bridged between a drive pulley 506 and a driven pulley 507.

The carriage 503 includes a liquid discharge device 540 mounting the liquid discharge head 504. The liquid discharge head 504 of the liquid discharge device 540 discharges ink droplets of each color of yellow (Y), cyan (C), magenta (M), and black (K). The liquid discharge head 504 includes nozzle rows including a plurality of nozzles arrayed in a sub-scanning direction indicated by arrow SSD in FIG. 17 perpendicular to the main scanning direction MSD, with the liquid discharge head 504 oriented downward. A supply circulation device 594 supplies liquid, which is stored outside the liquid discharge head 504, to the liquid discharge head 504 through a supply tube 556 to supply and circulate liquid to the liquid discharge head 504. Note that, in this embodiment, the supply circulation device 594 includes, e.g., the supply tank 531, the circulation tank 532, the compressor 533, the vacuum pump 534, the first liquid feed pump 535, the second liquid feed pump 536, and the regulator (R) 539*a*, and the regulator (R) 539*b*. The supply pressure sensor 537 is disposed between the supply tank 531 and the liquid discharge head 504 and connected to a supply channel connected to the supply port 71 of the liquid discharge head 504. The circulation pressure sensor 538 is disposed between the liquid discharge head 504 and the circulation tank 532 and is connected to a circulation channel connected to the circulation port 72 of the liquid discharge head 504.

The liquid discharge apparatus 1000 includes a conveyance device 595 to convey a sheet 510. The conveyance device 595 includes a conveyance belt 512 as a conveyor and a sub-scanning motor 516 to drive the conveyance belt 512. The conveyance belt 512 is disposed at a position opposite the liquid discharge head 504 to attract and convey the sheet 510. The conveyance belt 512 is an endless belt wound around a conveyance roller 513 and a tension roller 514. The attraction of the sheet 510 onto the conveyance belt 512 is performed by electrostatic attraction or air suction. The conveyance roller 513 is rotated by the sub-scanning motor 516 via a timing belt 517 and a timing pulley 518, so that the conveyance belt 512 circulates in the sub-scanning direction indicated by arrow SSD in FIG. 17.

At one end in the main scanning direction MSD of the carriage 503, a maintenance device 520 is disposed at a lateral side of the conveyance belt 512 to maintain and recover the liquid discharge head 504. The maintenance device 520 includes, e.g., a cap 521 to cap a nozzle face (a face in which nozzles are formed) of the liquid discharge head 504 and a wiper 522 to wipe the nozzle face.

The main-scanning moving device 593, the supply circulation device 594, the maintenance device 520, and the conveyance device 595 are mounted to a housing including, e.g., side plates 591A and 591B and a back plate 591C. For the liquid discharge apparatus 1000 thus configured, the sheet 510 is fed and attracted onto the conveyance belt 512 and conveyed in the sub-scanning direction SSD with rotation of the conveyance belt 512. By driving the liquid discharge head 504 in accordance with an image signal while moving the carriage 503 in the main scanning direction MSD, liquid is discharged onto the sheet 510, which is stopped below the liquid discharge head 504, to form an image. As described above, the liquid discharge apparatus 1000 includes the liquid discharge head 504, thus allowing stable formation of high quality images.

Next, another example of the liquid discharge device 540 is described with reference to FIG. 19.

Figure 19:
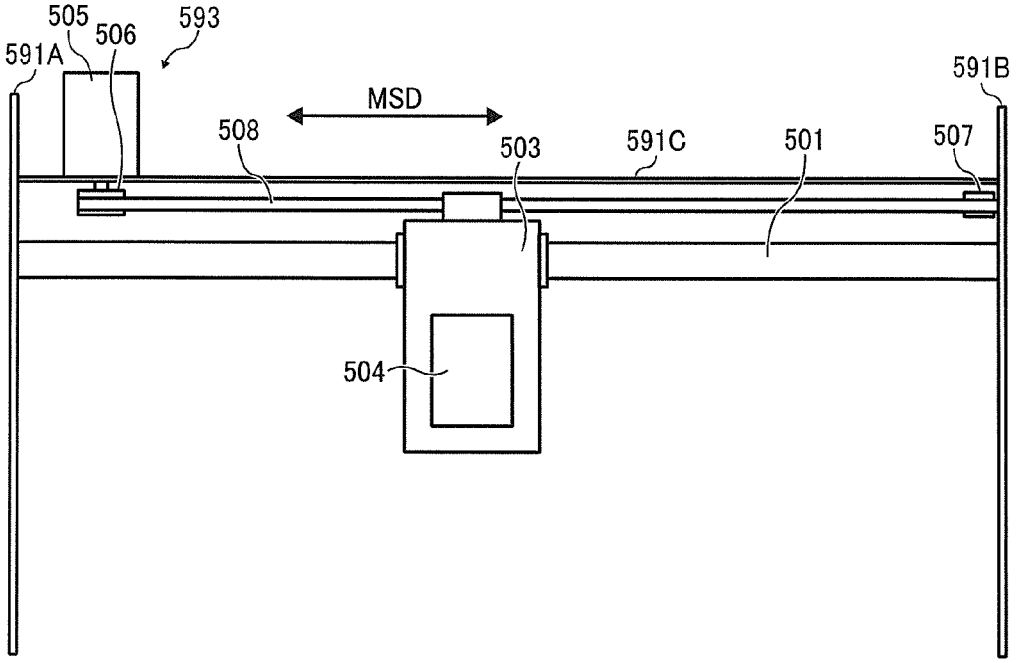
FIG. 19 is a plan view of a portion of another example of the liquid discharge device.

FIG. 19 is a plan view of a portion of another example of the liquid discharge device 540. In this example, the liquid discharge device 540 includes a housing portion including the side plates 591A and 591B and the back plate 591C, the main-scanning moving device 593, the carriage 503, and the liquid discharge head 504. Note that the liquid discharge device 540 may be configured so that at least one of the above-described maintenance device 520 and the supply circulation device 594 is further mounted to, for example, the side plate 591B of the liquid discharge device 540.

In the above-described embodiments, the term "liquid discharge head" used herein is a functional component to discharge or jet liquid from nozzles. The liquid discharged from the liquid discharge head is not limited to a particular liquid as long as the liquid has a viscosity or surface tension dischargeable from the head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and functional parts, or the liquid discharge head and other structures, and denotes an assembly of parts relative to the liquid discharge. For example, the liquid discharge device may be formed of a combination of the liquid discharge head with at least one of the supply circulation device, the carriage, the maintenance device, and the main-scanning moving device. Herein, examples of the integrated unit include a combination in which the liquid discharge head and a functional part(s) are combined fixedly to each other through, e.g., fastening, bonding, or engaging, and a combination in which one of the liquid discharge head and a functional part(s) is movably held by another. In addition, the liquid discharge head can be detachably attached to the functional parts or structures each other.

For example, the liquid discharge head and the supply circulation device are integrated as the liquid discharge device. The liquid discharge head and the supply circulation device may be connected each other via, e.g., a tube to integrally form the liquid discharge device. Here, a unit including a filter may further be added to a portion between the supply circulation device and the liquid discharge head, thereby forming another liquid discharge device. In another example, the liquid discharge device may include a liquid discharge head integrated with a carriage as a single unit. In still another example, the liquid discharge device includes the liquid discharge head movably held by a guide that forms part of a main-scanning moving device, so that the liquid discharge head and the main-scanning moving device are integrated as a single unit. Furthermore, in another example, the cap that forms part of the maintenance device is secured to the carriage mounted with the liquid discharge head so that the liquid discharge head, the carriage, and the maintenance device are integrated as a single unit to form the liquid discharge device. Further, in another example, the liquid discharge device includes tubes connected to the supply circulation device or the channel member mounted on the liquid discharge head so that the liquid discharge head and the supply device are integrated as a single unit. Liquid is supplied from a liquid reservoir source to the liquid discharge head. The main-scanning moving device may include only a guide, such as the guide 501. The supply device may include only a tube(s) or a loading unit.

The term "liquid discharge apparatus" used herein is an apparatus including the liquid discharge head or the liquid discharge device to discharge liquid by driving the liquid discharge head. As the liquid discharge apparatus, there are an apparatus capable of discharging liquid to a material on which liquid can be adhered as well as an apparatus to discharge liquid toward gas or liquid. The liquid discharge apparatus may include devices to feed, convey, and eject the material on which liquid can be adhered. The liquid discharge apparatus may further include a pretreatment apparatus to coat a treatment liquid onto the material, and a post-treatment apparatus to coat a treatment liquid onto the material, onto which the liquid has been discharged.

Examples of the liquid discharge apparatus include an image forming apparatus to form an image on a sheet by discharging ink, and a three-dimensional apparatus to discharge a molding liquid to a powder layer in which powder material is formed in layers, so as to form a three-dimensional article. In addition, the liquid discharge apparatus is not limited to such an apparatus to form and visualize meaningful images, such as letters or figures, with discharged liquid. For example, the liquid discharge apparatus may be an apparatus to form meaningless images, such as patterns, or fabricate three-dimensional objects.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited. Examples of the material on which liquid can be adhered include any materials on which liquid can be adhered even temporarily, such as paper, thread, fiber, fabric, leather, metal, plastic, glass, wood, and ceramic.

The "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head. Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials. The term "image formation" means not only recording, but also printing, image printing, molding, and the like.

The above-described embodiments and examples are limited examples, and the present disclosure includes, for example, the following aspects having advantages.

Aspect A

A liquid discharge head, such as the liquid discharge head 434, includes: a nozzle row including a plurality of nozzles, such as the plurality of nozzles 31, to discharge liquid, such as ink, the plurality of nozzles arrayed in a nozzle array direction; a plurality of individual liquid chambers, such as the plurality of pressure generation chambers 22, communicated with the plurality of nozzles and arrayed in the nozzle array direction; a common liquid chamber, such as the common liquid chamber 12, extending longer in the nozzle array direction, to supply liquid to the plurality of individual liquid chambers; a circulation liquid chamber, such as the circulation liquid chamber 43, communicated with the plurality of individual liquid chambers; a supply port, such as the supply port 71, disposed at a center of the common liquid chamber in the nozzle array direction, to supply liquid to the common liquid chamber; and a delivery port, such as the circulation port 72, disposed outside the common liquid chamber in the nozzle array direction, to deliver liquid from the circulation liquid chamber. In aspect A, the supply port is disposed at a center of the common liquid chamber in the nozzle array direction and the delivery port is disposed outside the common liquid chamber in the nozzle array direction. Such a configuration allows a smaller width of the liquid discharge head in the nozzle array direction than a configuration in which the supply port is disposed at one end of the common liquid chamber in the nozzle array direction and the delivery port is disposed outside the common liquid chamber in the nozzle array direction. Thus, such a configuration prevents an increase in the size of the liquid discharge head in the nozzle array direction.

Aspect B

In aspect A, the delivery port is disposed outside each end of the common liquid chamber in the nozzle array direction. As described in the above-described embodiments, such a configuration allows the length of a channel of liquid from the supply port to the delivery port to be the same in any of the individual liquid chambers.

Aspect C

In aspect A or B, the common liquid chamber has a greater cross-sectional area in a direction perpendicular to a direction of flow of liquid than a cross-sectional area of the circulation liquid chamber in the direction perpendicular to the direction of flow of liquid. As described in the above-described embodiments, such a configuration reduces the pressure loss in the common liquid chamber.

Aspect D

In aspects A through C, the common liquid chamber has a fluid resistance value smaller than a fluid resistance value of the circulation liquid chamber. As described in the above-described embodiments, such a configuration reduces the pressure loss due to the flow of liquid for circulation and the flow of liquid for discharge.

Aspect E

A liquid discharge device includes the liquid discharge head according to any one of aspects A through D and at least one of a head tank, such as the supply tank 531 or the circulation tank 532, a carriage, such as the carriage 503, a supply device, such as the supply circulation device 594, a maintenance device, such as the maintenance device 520, and a main-scanning moving device, such as the main-scanning moving device 593. As described in the above-described embodiments, such a configuration downsizes the liquid discharge head, thus reducing the size of the liquid discharge device.

Aspect F

A liquid discharge apparatus includes the liquid discharge head according to any one of aspects A through D. As described in the above-described embodiments, such a configuration downsizes the liquid discharge head, thus reducing the size of the liquid discharge apparatus.

Aspect G

A liquid discharge apparatus includes the liquid discharge device according to aspect E. As described in the above-described embodiments, such a configuration downsizes the liquid discharge device, thus reducing the size of the liquid discharge apparatus.

Aspect H

An image forming apparatus, such as a printer, includes the liquid discharge head, such as the liquid discharge head 434, according to any one of aspects A through D to discharge liquid droplets to form an image. As described in the above-described embodiments, such a configuration downsizes the liquid discharge head, thus reducing the size of the image forming apparatus.

Aspect I

An image forming apparatus includes the liquid discharge device according to aspect E to discharge liquid droplets from the liquid discharge head to from an image. As described in the above-described embodiments, such a configuration downsizes the liquid discharge device, thus reducing the size of the image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle row including a plurality of nozzles to discharge liquid, the plurality of nozzles arrayed in a nozzle array direction;

a plurality of individual liquid chambers communicated with the plurality of nozzles, respectively, and arrayed in the nozzle array direction;

a common liquid chamber extending longer in the nozzle array direction and communicated with the plurality of individual liquid chambers at an upstream of the plurality of individual liquid chambers in a liquid flow direction;

a circulation liquid chamber communicated with the plurality of individual liquid chambers at a downstream of the individual liquid chambers in the liquid flow direction, wherein for each individual liquid chamber amongst the plurality of individual liquid chambers, the individual liquid chamber includes a communication channel from the common liquid chamber, and a corresponding nozzle amongst the plurality of nozzles is disposed along the corresponding communication channel to discharge a portion of liquid in the individual liquid chamber;

a supply port disposed at a center of the common liquid chamber in the nozzle array direction, to supply liquid to the common liquid chamber; and a delivery port disposed at the circulation liquid chamber to deliver liquid from the circulation liquid chamber.

2. The liquid discharge head according to claim 1, wherein the circulation liquid chamber extends in the nozzle array direction, and the delivery port is disposed at each end of the circulation liquid chamber in the nozzle array direction.

3. The liquid discharge head according to claim 1, wherein the common liquid chamber has a greater cross-sectional area in a direction perpendicular to a direction of flow of liquid than a cross-sectional area of the circulation liquid chamber in the direction perpendicular to the direction of flow of liquid.

4. A liquid discharge device comprising:

the liquid discharge head according to claim 1; and at least one of a head tank, a carriage, a supply device, a maintenance device, and a main-scanning moving device.

5. A liquid discharge apparatus comprising the liquid discharge device according to claim 4.

6. An image forming apparatus comprising the liquid discharge device according to claim 4 to discharge liquid droplets from the liquid discharge head to form an image.

7. A liquid discharge apparatus comprising the liquid discharge head according to claim 1.

8. An image forming apparatus comprising the liquid discharge head according to claim 1 to discharge liquid droplets to form an image.

9. The liquid discharge head according to claim 1, wherein the circulation liquid chamber is disposed at a position closer than the common liquid chamber is to the plurality of nozzles.

10. The liquid discharge head according to claim 1, wherein plural wall faces form the common liquid chamber and are interposed between plural delivery ports, and each delivery port amongst the plural delivery ports is disposed adjacent to a corresponding wall face amongst the plural wall faces.

11. A liquid discharge head comprising:

a nozzle row including a plurality of nozzles to discharge liquid, the plurality of nozzles arrayed in a nozzle array direction;

a plurality of individual liquid chambers communicated with the plurality of nozzles and arrayed in the nozzle array direction;

a common liquid chamber extending longer in the nozzle array direction, to supply liquid to the plurality of individual liquid chambers;

a circulation liquid chamber communicated with the plurality of individual liquid chambers;

a supply port disposed at a center of the common liquid chamber in the nozzle array direction, to supply liquid to the common liquid chamber; and a delivery port disposed outside the circulation liquid chamber in the nozzle array direction, to deliver liquid from the circulation liquid chamber wherein the common liquid chamber has a fluid resistance value smaller than a fluid resistance value of the circulation liquid chamber.

12. A liquid discharge device comprising:

the liquid discharge head according to claim 11; and at least one of a head tank, a carriage, a supply device, a maintenance device, and a main-scanning moving device.

13. A liquid discharge apparatus comprising the liquid discharge device according to claim 12.

14. An image forming apparatus comprising the liquid discharge device according to claim 12 to discharge liquid droplets from the liquid discharge head to form an image.

15. A liquid discharge apparatus comprising the liquid discharge head according to claim 11.

16. An image forming apparatus comprising the liquid discharge head according to claim 4 to discharge liquid droplets to form an image.

* * * * *